US007784530B2

(12) United States Patent
Ohashi

(10) Patent No.: US 7,784,530 B2
(45) Date of Patent: Aug. 31, 2010

(54) HEAT EXCHANGER

(75) Inventor: Hideo Ohashi, Oyama (JP)

(73) Assignee: Showa Denko K.K., Tokyo (JP)

( * ) Notice: Subject to any disclaimer, the term of this patent is extended or adjusted under 35 U.S.C. 154(b) by 1005 days.

(21) Appl. No.: 11/514,084

(22) Filed: Sep. 1, 2006

(65) Prior Publication Data

US 2007/0044949 A1 Mar. 1, 2007

(30) Foreign Application Priority Data

Sep. 1, 2005 (JP) ..... 2005-253069

(51) Int. Cl.
*F28D 7/06* (2006.01)

(52) U.S. Cl. ..... 165/176; 165/149; 165/173; 228/183

(58) Field of Classification Search ..... 165/149, 165/176, 175, 153, 173; 228/183
See application file for complete search history.

(56) References Cited

U.S. PATENT DOCUMENTS 5,535,819 A * 7/1996 Matsuura ..... 165/149
6,012,513 A * 1/2000 Iokawa et al. ..... 165/149
6,276,445 B1 * 8/2001 Sasano et al. ..... 165/135
6,357,520 B1 * 3/2002 Kato et al. ..... 165/149
6,736,197 B2 * 5/2004 Nozaki et al. ..... 165/149
7,066,243 B2 * 6/2006 Horiuchi et al. ..... 165/176
7,207,378 B2 * 4/2007 Kroetsch et al. ..... 165/149
7,303,003 B2 * 12/2007 Ohhashi et al. ..... 165/149

FOREIGN PATENT DOCUMENTS

JP 2005-164226 6/2005

OTHER PUBLICATIONS

U.S. Appl. No. 10/580,457, filed May 24, 2006, Ohashi.

* cited by examiner

*Primary Examiner*—Terrell L McKinnon
(74) *Attorney, Agent, or Firm*—Oblon, Spivak, McClelland, Maier & Neustadt, L.L.P.

(57) ABSTRACT

In manufacture of a heat exchanger, heat exchange tubes, fins, and header section bodies are arrange in an assembled condition. Projection pieces provided on caps of header sections are fitted into corresponding slits formed in side plates, thereby engaging end portions of the side plates with the caps. In this condition, the caps are arranged in such a manner as to bridge end portions of the header section bodies, and the side plates are arranged on the outer sides of the leftmost and rightmost fins. The heat exchange tubes and the fins, the heat exchange tubes and the header section bodies, the header section bodies and the caps, the side plates and the caps, and the side plates and the fins are respectively brazed together simultaneously. This method enables the side plates to be accurately arranged at respectively predetermined positions.

5 Claims, 11 Drawing Sheets

HEAT EXCHANGER

BACKGROUND OF THE INVENTION

The present invention relates to a heat exchanger preferably used as an evaporator of a car air conditioner, which is a refrigeration cycle to be mounted on, for example, an automobile, and a method of manufacturing the same.

Herein and in the appended claims, the left-hand and right-hand sides of FIG. 2 will be referred to as "left" and "right," respectively.

Conventionally, a so-called laminated evaporator has been widely employed as an evaporator for use in a car air conditioner. In the laminated evaporator, a plurality of flat, hollow members, each of which includes a pair of depressed plates facing each other and brazed to each other at their peripheral edge portions, are arranged in parallel, and corrugate fins are each disposed between and brazed to the adjacent flat, hollow members.

However, in recent years, evaporators have been demanded to further reduce size and weight and to exhibit higher performance. The present applicant proposed a heat exchanger for use in an evaporator which fulfills those requirements (refer to Japanese Patent Application Laid-Open (kokai) No. 2005-164226). The proposed heat exchanger includes a heat exchange core section, a first header section, a second header section, a third header section, and a fourth header section. The heat exchange core section includes a plurality of rows of heat exchange tube groups arranged in an air flow direction, each heat exchange tube group consisting of a plurality of heat exchange tubes arranged in a left-right direction at predetermined intervals; a plurality of corrugate fins disposed between and joined to the adjacent heat exchange tubes and disposed on the outer sides of and joined to the leftmost and rightmost heat exchange tubes; and two side plates disposed on the outer sides of the leftmost and rightmost corrugate fins, respectively, and joined thereto. The first header section is disposed on a first-end side of the heat exchange tubes, and the heat exchange tubes of at least a single heat exchange tube group are connected thereto. The second header section is disposed on the first-end side of the heat exchange tubes and upstream of the first header section with respect to the air flow direction, and the heat exchange tubes of the remaining heat exchange tube group(s) are connected thereto. The third header section is disposed on a second-end side of the heat exchange tubes, and the heat exchange tubes connected to the first header section are connected thereto. The fourth header section is disposed on the second-end side of the heat exchange tubes, and the heat exchange tubes connected to the second header section are connected thereto. The first and second header sections include two hollow header section bodies whose left and right ends are open, and two caps which are joined to left and right end portions of the two header section bodies while bridging the left end portions and the right end portions, respectively, thereby closing openings of the left and right ends of the two header section bodies. The third and fourth header sections include two hollow header section bodies whose left and right ends are open, and two caps which are joined to left and right end portions of the two header section bodies while bridging the left end portions and the right end portions, respectively, thereby closing openings of the left and right ends of the two header section bodies.

The heat exchanger disclosed in the above publication is manufactured through steps of assembling and provisionally joining the respective constituent members, and brazing all the constituent members together. Specifically, this heat exchanger is manufactured through steps of arranging the heat exchange tubes, the corrugate fins, and the header section bodies in an assembled condition; provisionally joining the constituent members, while the caps are arranged in such a manner as to bridge end portions of the header section bodies on opposite sides of the header section bodies, and the side plates are arranged, independently of the caps, on the outer sides of the leftmost and rightmost corrugate fins; and simultaneously brazing the heat exchange tubes and the corrugate fins together, the heat exchange tubes and the header section bodies together, the header section bodies and the caps together, and the corrugate fins and the side plates together.

However, manufacturing the heat exchanger disclosed in the above publication involves difficulty in arranging the side plates at respectively predetermined positions.

SUMMARY OF THE INVENTION

An object of the present invention is to solve the above problem and to provide a heat exchanger whose side plates can be accurately arranged at respectively predetermined positions, as well as a method of manufacturing the same.

To achieve the above object, the present invention comprises the following modes.

A heat exchanger comprising: a heat exchange core section comprising a plurality of rows of heat exchange tube groups arranged in an air flow direction, each heat exchange tube group consisting of a plurality of heat exchange tubes arranged in a left-right direction at predetermined intervals, a plurality of fins disposed between and joined to the adjacent heat exchange tubes and disposed on the outer sides of and joined to the leftmost and rightmost heat exchange tubes, and two side plates disposed on the outer sides of the leftmost and rightmost fins, respectively, and joined thereto; a first header section which is disposed on a first-end side of the heat exchange tubes and to which the heat exchange tubes of at least a single heat exchange tube group are connected; a second header section which is disposed on the first-end side of the heat exchange tubes and upstream of the first header section with respect to the air flow direction and to which the heat exchange tubes of the remaining heat exchange tube group(s) are connected; a third header section which is disposed on a second-end side of the heat exchange tubes and to which the heat exchange tubes connected to the first header section are connected; and a fourth header section which is disposed on the second-end side of the heat exchange tubes and to which the heat exchange tubes connected to the second header section are connected.

The first and second header sections have two hollow header section bodies whose left and right ends are open, and two caps which are joined to left and right end portions of the two header section bodies while bridging the left end portions and the right end portions, respectively, thereby closing openings of the left and right ends of the two header section bodies. The third and fourth header sections have two hollow header section bodies whose left and right ends are open, and two caps which are joined to left and right end portions of the two header section bodies while bridging the left end portions and the right end portions, respectively, thereby closing openings of the left and right ends of the two header section bodies While end portions of the side plates are engaged with the respective caps, the side plates are joined to the caps and fins.

In the heat exchanger, a projection piece projecting inward with respect to the left-right direction may be provided on each of the caps; a through-hole portion for allowing the projection piece of the cap to be inserted thereinto may be formed at an end portion of each of the side plates; and the projection piece of the cap may be inserted into the through-hole portion of the side plate, whereby the end portion of the side plate is engaged with the cap.

In the heat exchanger, a plurality of the projection pieces may be provided on the cap at predetermined intervals in the air flow direction, and a plurality of the through-hole portions corresponding to the projection pieces may be formed in the side plate.

In the heat exchanger, the projection piece of the cap may have the form of a vertical plate body whose thickness direction coincides with the air flow direction and whose width direction coincides with a longitudinal direction of the side plate, and the through-hole portion of the side plate may have the form of a slit extending in the longitudinal direction of the side plate.

In the heat exchanger, each of the caps may have concave portions to be fitted into the corresponding header section bodies.

In the heat exchanger, the header section body of the first header section and the header section body of the second header section may be integral with each other.

In the heat exchanger, the header section body of the third header section and the header section body of the fourth header section may be integral with each other.

A method of manufacturing a heat exchanger which comprises a heat exchange core section comprising a plurality of rows of heat exchange tube groups arranged in an air flow direction, each heat exchange tube group consisting of a plurality of heat exchange tubes arranged in a left-right direction at predetermined intervals, a plurality of fins disposed between and joined to the adjacent heat exchange tubes and disposed on the outer sides of and joined to the leftmost and rightmost heat exchange tubes, and two side plates disposed on the outer sides of the leftmost and rightmost fins, respectively, and joined thereto; a first header section which is disposed on a first-end side of the heat exchange tubes and to which the heat exchange tubes of at least a single heat exchange tube group are connected; a second header section which is disposed on the first-end side of the heat exchange tubes and upstream of the first header section with respect to the air flow direction and to which the heat exchange tubes of the remaining heat exchange tube group(s) are connected; a third header section which is disposed on a second-end side of the heat exchange tubes and to which the heat exchange tubes connected to the first header section are connected; and a fourth header section which is disposed on the second-end side of the heat exchange tubes and to which the heat exchange tubes connected to the second header section are connected; the first and second header sections comprising two hollow header section bodies whose left and right ends are open, and two caps which are joined to left and right end portions of the two header section bodies while bridging the left end portions and the right end portions, respectively, thereby closing openings of the left and right ends of the two header section bodies, and the third and fourth header sections comprising two hollow header section bodies whose left and right ends are open, and two caps which are joined to left and right end portions of the two header section bodies while bridging the left end portions and the right end portions, respectively, thereby closing openings of the left and right ends of the two header section bodies The method comprising the steps of: arranging the heat exchange tubes, the fins, and the header section bodies in an assembled condition; with end portions of the side plates engaged with the caps, arranging the caps in such a manner as to bridge left end portions of the header section bodies and to bridge the right end portions of the header section bodies, and arranging the side plates on the outer sides of the leftmost and rightmost fins; and simultaneously brazing the heat exchange tubes and the fins together, the heat exchange tubes and the header section bodies together, the header section bodies and the caps together, the side plates and the caps together, and the side plates and the fins together.

In the method of manufacturing a heat exchanger, a projection piece projecting inward with respect to the left-right direction may be provided on each of the caps; a through-hole portion for allowing the projection piece of the cap to be inserted thereinto in a manner movable in the left-right direction is formed at an end portion of each of the side plates; and the projection piece of the cap is inserted into the through-hole portion of the side plate, whereby the end portion of the side plate is engaged with the cap.

In the method of manufacturing a heat exchanger, a plurality of the projection pieces may be provided on the cap at predetermined intervals in the air flow direction, and a plurality of the through-hole portions corresponding to the projection pieces may be formed in the side plate.

In the method of manufacturing a heat exchanger, the projection piece of the cap may have the form of a vertical plate body whose thickness direction coincides with the air flow direction and whose width direction coincides with a longitudinal direction of the side plate, and the through-hole portion of the side plate may have the form of a slit extending in the longitudinal direction of the side plate.

In the method of manufacturing a heat exchanger, each of the caps may have concave portions to be fitted into the corresponding header section bodies.

The above-mentioned heat exchanger is preferably used as an evaporator in a refrigeration cycle having a compressor, a refrigerant cooler, and an evaporator. This refrigeration cycle is mounted on a vehicle in the form of, for example, an air conditioner.

In the heat exchanger of par. 1), while end portions of the side plates are engaged with the caps, the side plates are joined to the caps and to the fins. Accordingly, in manufacture of this heat exchanger, after the heat exchange tubes, the fins, and the header section bodies are arranged in an assembled condition, merely by, with end portions of the side plates engaged with the caps, arranging the caps in such a manner as to bridge left end portions of the header section bodies and to bridge the right end portions of the header section bodies, the side plates can be arranged on the outer sides of the leftmost and rightmost fins. Thus, in manufacture of the heat exchanger, the side plates can be arranged accurately at respectively predetermined positions. Furthermore, since, in manufacture of the heat exchanger, the side plates can be arranged accurately at respectively predetermined positions, detachment or dislocation of the leftmost and rightmost fins can be prevented.

In the heat exchanger of any one of pars. 2) to 4), end portions of the side plates can be engaged with the caps in a relatively easy manner.

In the heat exchanger of par. 5), each of the caps has the concave portions to be fitted into the corresponding header section bodies. Thus, in manufacture of the heat exchanger, the caps can be accurately positioned in relation to the header section bodies. Accordingly, in manufacture of the heat exchanger, the side plates can be accurately positioned.

In the method of manufacturing a heat exchanger of par. 8), after the heat exchange tubes, the fins, and the header section bodies are arranged in an assembled condition, merely by, with end portions of the side plates engaged with the caps, arranging the caps in such a manner as to bridge left end portions of the header section bodies and to bridge the right end portions of the header section bodies, the side plates can be arranged on the outer sides of the leftmost and rightmost fins. Thus, in manufacture of the heat exchanger, the side plates can be arranged accurately at respectively predetermined positions. Furthermore, since, in manufacture of the heat exchanger, the side plates can be arranged accurately at respectively predetermined positions, detachment or dislocation of the leftmost and rightmost fins can be prevented.

The method of manufacturing a heat exchanger of par. 9) or 10) yields the following effects. Usually, the fins are formed from an aluminum brazing sheet having a brazing material layer on each of opposite sides thereof. In the course of brazing, the brazing material runs. Thus, the dimension of the heat exchange core section as measured in the left-right direction after brazing becomes smaller than that before brazing. However, in the course of brazing, employment of the configuration of par. 9) or 10) allows the side plates to move inward with respect to the left-right direction while being guided by the projection pieces of the caps; i.e., the side plates can follow dimensional changes associated with brazing.

In the method of manufacturing a heat exchanger of par. 11), the projection pieces of the caps and the through-hole portions of the side plates can be formed in a relatively easy manner.

In the method of manufacturing a heat exchanger of par. 12), each of the caps has the concave portions to be fitted into the corresponding header section bodies. Thus, the caps can be accurately positioned in relation to the header section bodies. Accordingly, the side plates can be accurately positioned.

DESCRIPTION OF THE PREFERRED EMBODIMENT

An embodiment of the present invention will next be described in detail with reference to the drawings.

Figure 4:
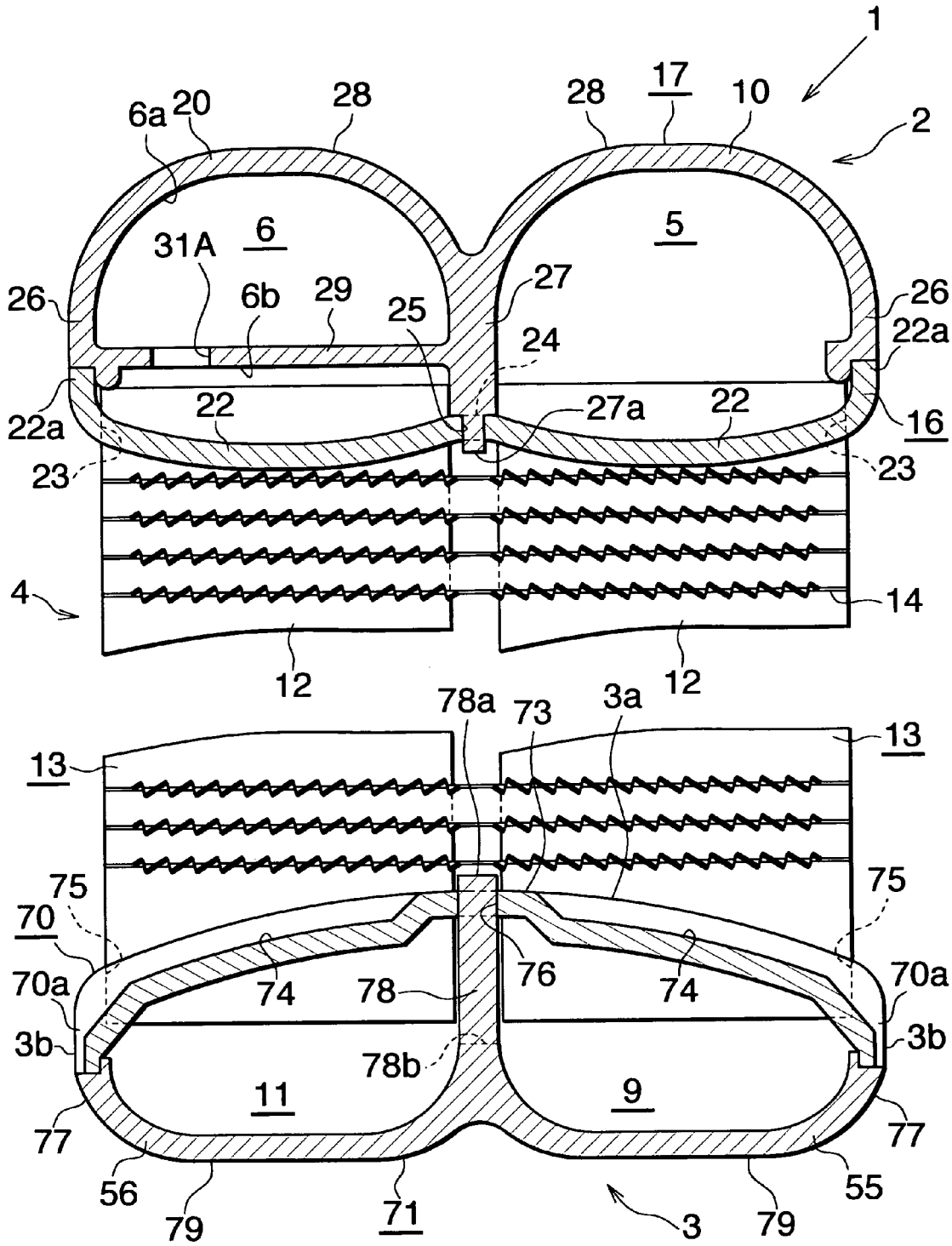
FIG. 4 is an enlarged fragmentary view in section taken along line A-A of FIG. 2.
Figure 5:
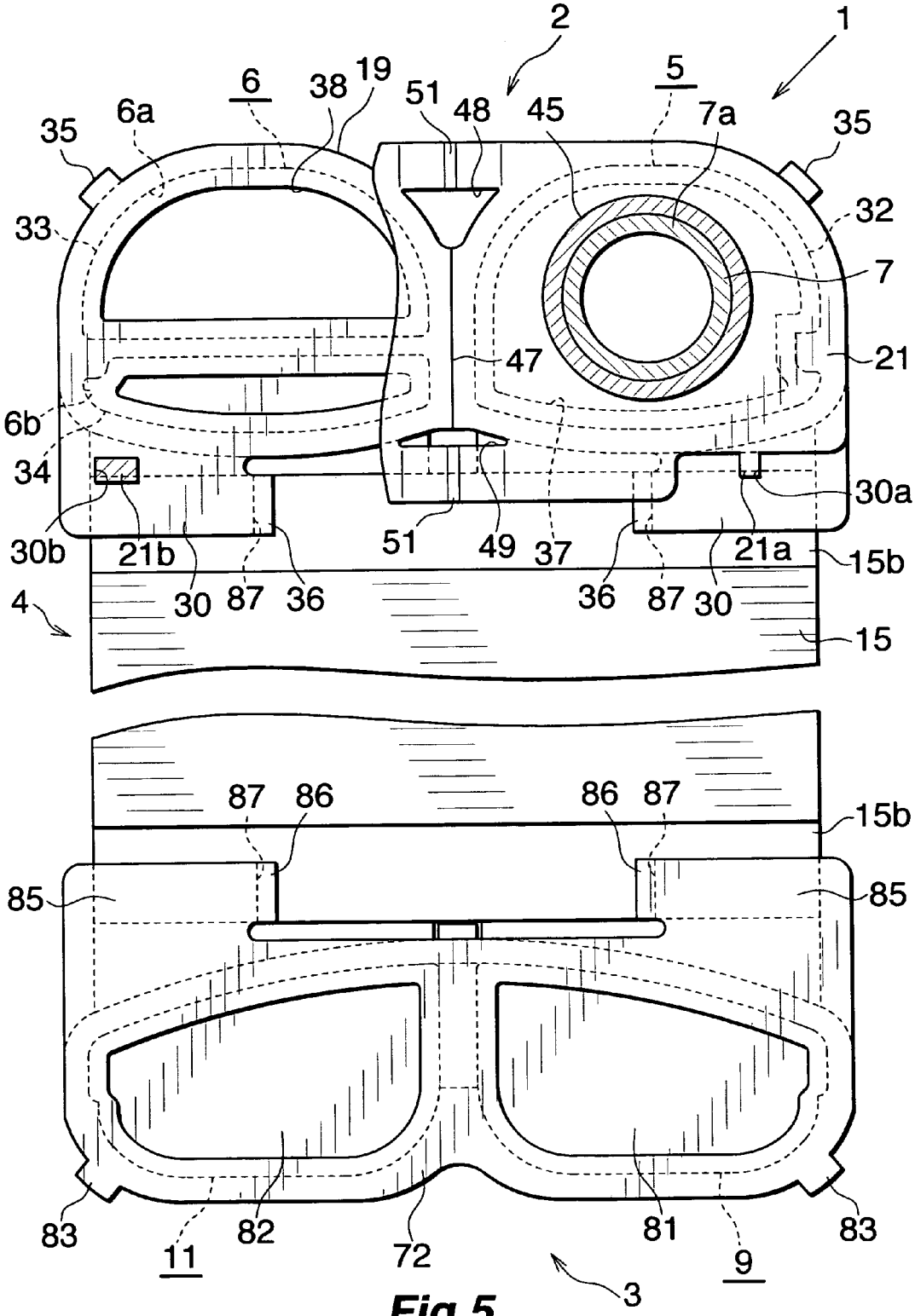
FIG. 5 is an enlarged fragmentary view in section taken along line B-B of FIG. 2.
Figure 6:
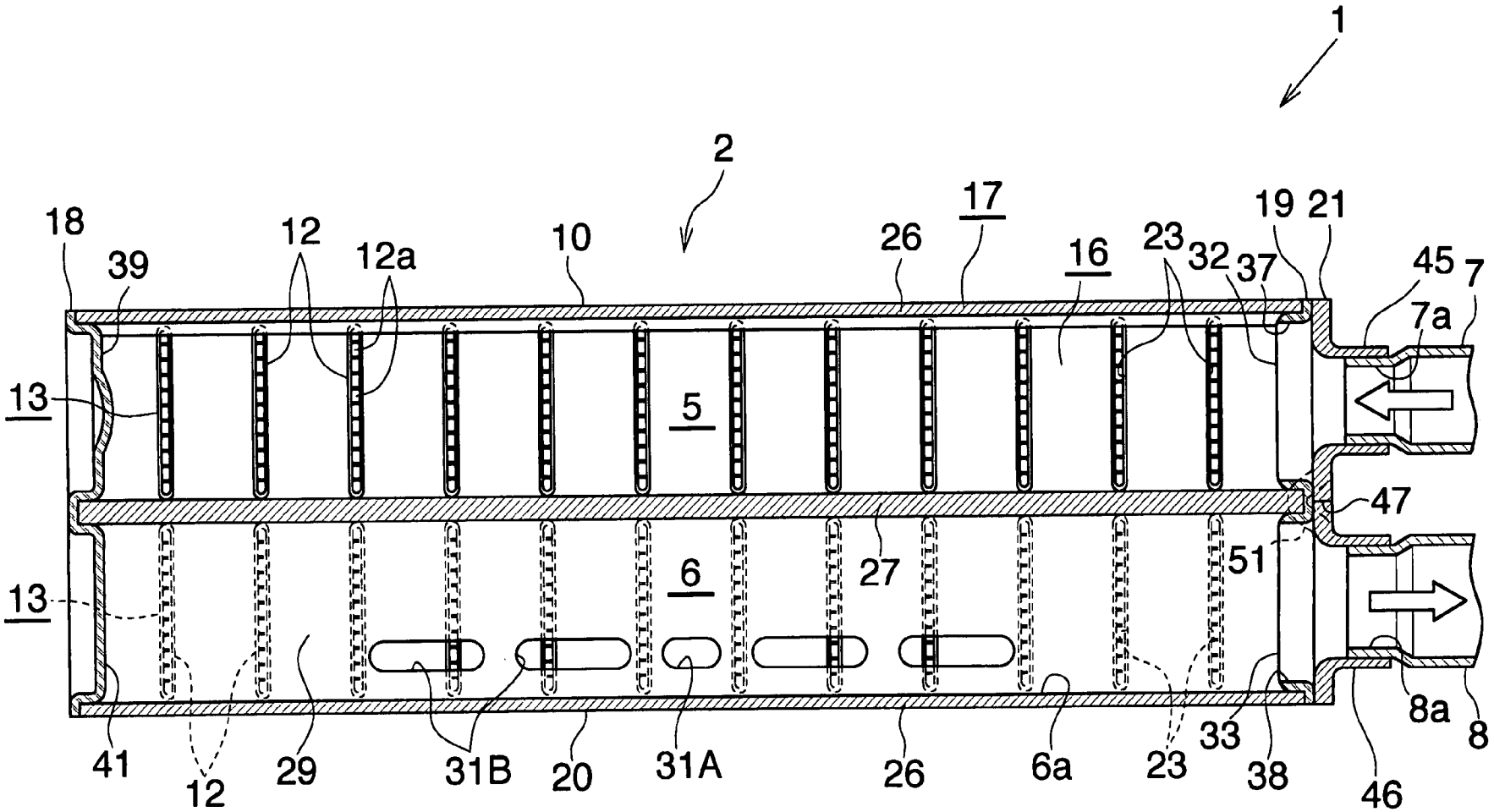
FIG. 6 is a sectional view taken along line C-C of FIG. 2.
Figure 7:
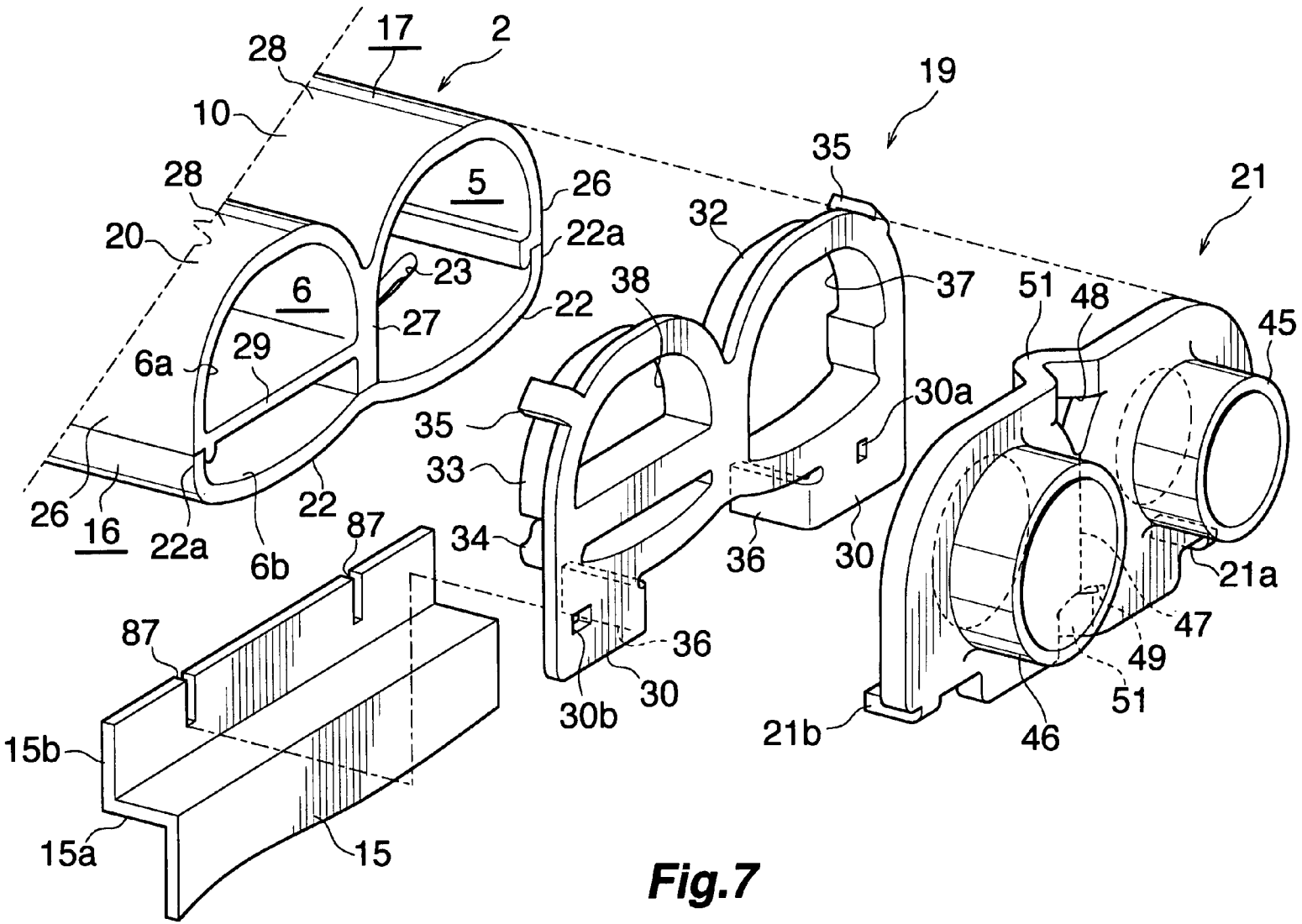
FIG. 7 is a fragmentary, enlarged, exploded perspective view showing two header section bodies of the refrigerant inlet/outlet tank, a right cap, a pipe joint member, and a right side plate of the evaporator of FIG. 1.
Figure 8:
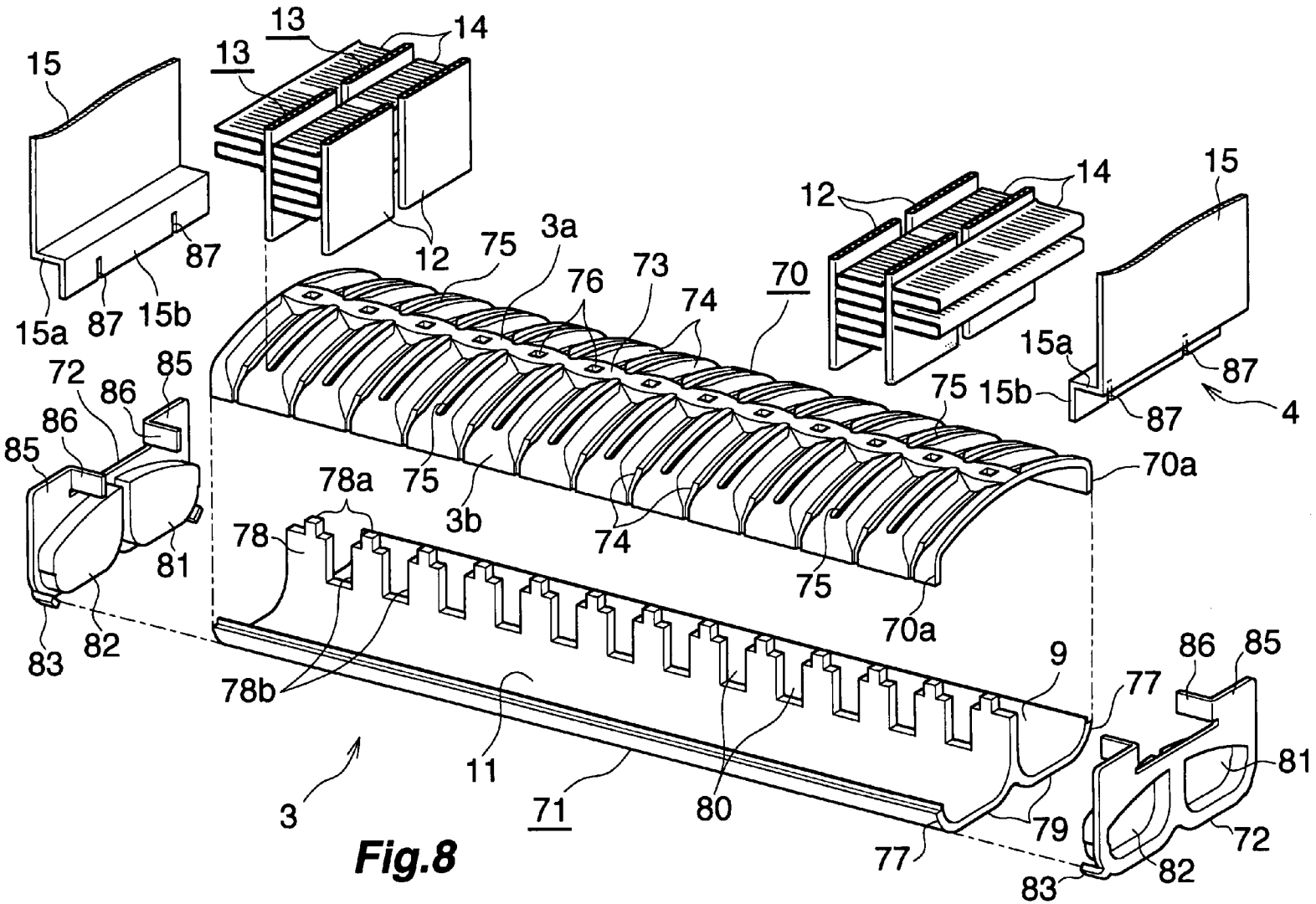
FIG. 8 is an exploded perspective view of a refrigerant turn tank of the evaporator of FIG. 1.
Figure 9:
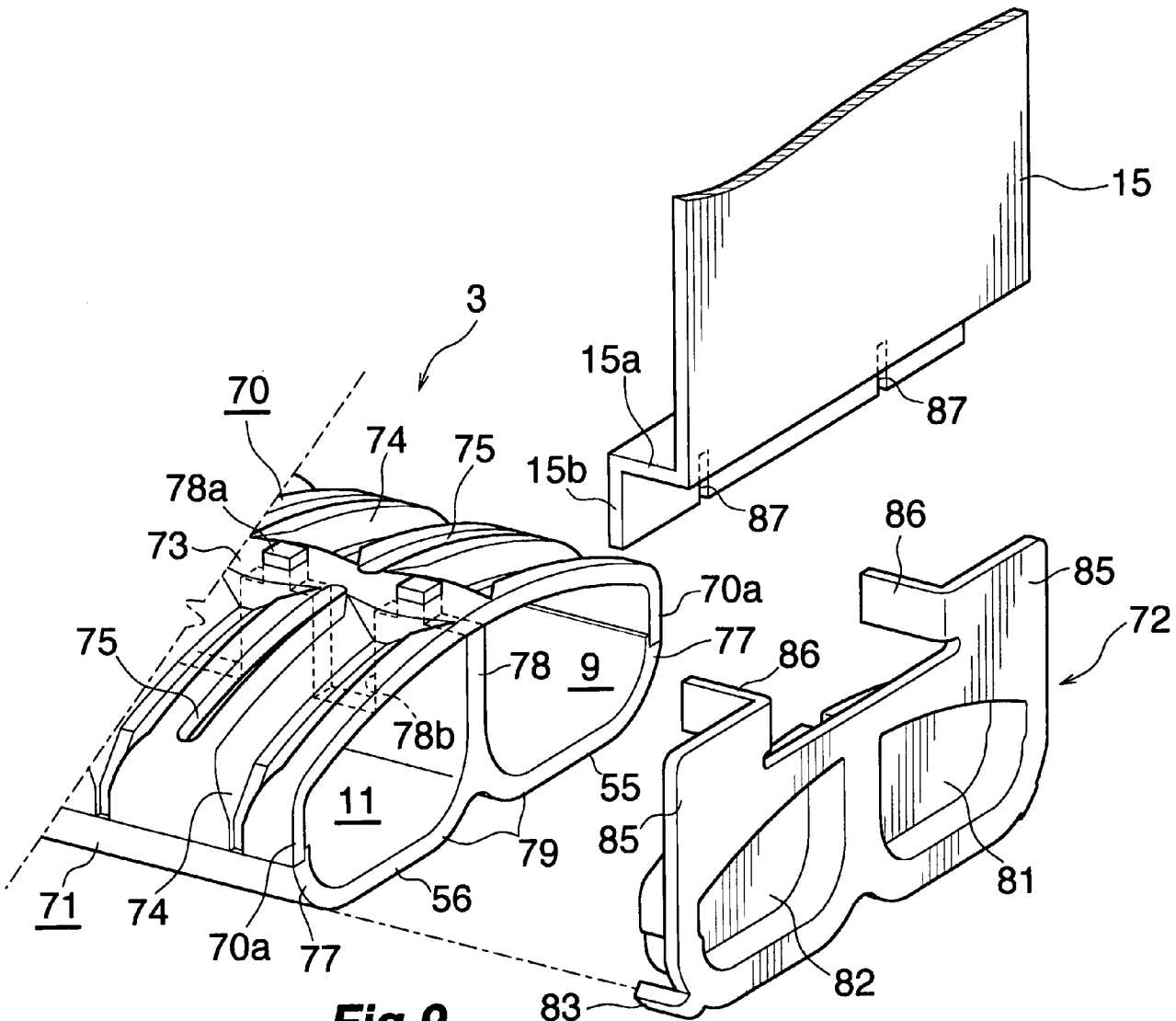
FIG. 9 is a fragmentary, enlarged, exploded perspective view showing two header section bodies of the refrigerant turn tank, a right cap, a pipe joint member, and a right side plate of the evaporator of FIG. 1.

Herein, the term "aluminum" encompasses aluminum alloys in addition to pure aluminum. Also, the downstream side (a direction represented by arrow X in FIGS. 1 and 10; the right side of FIG. 4) of an air flow through air passing clearances between adjacent heat exchange tubes will be referred to as the "front," and the opposite side as the "rear." Further, the upper and lower sides of FIGS. 1 and 2 will be referred to as "up" and "down," respectively.

Figure 1:
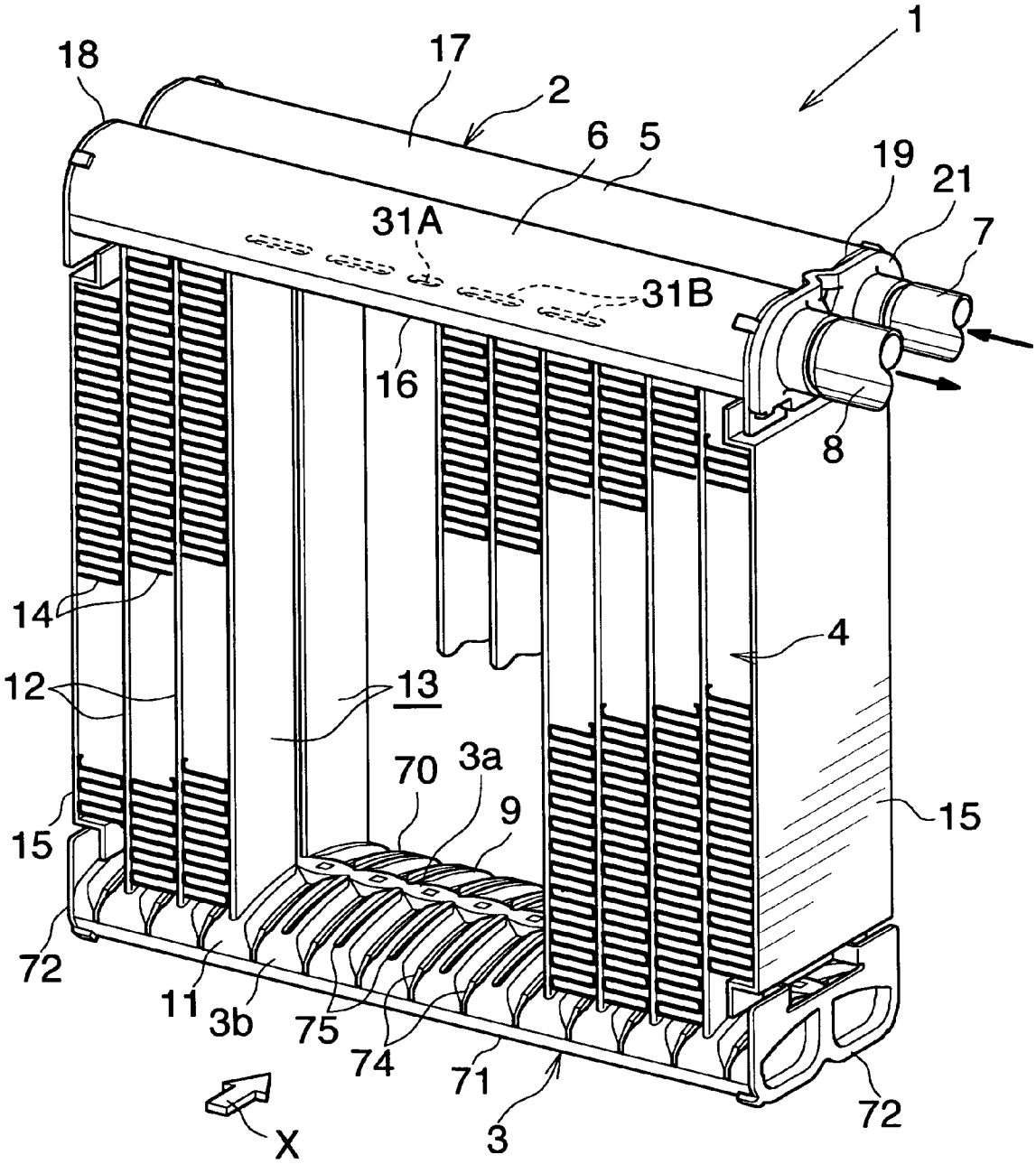
FIG. 1 is a partially cut-away perspective view showing the overall configuration of an evaporator to which a heat exchanger according to the present invention is applied.
Figure 2:
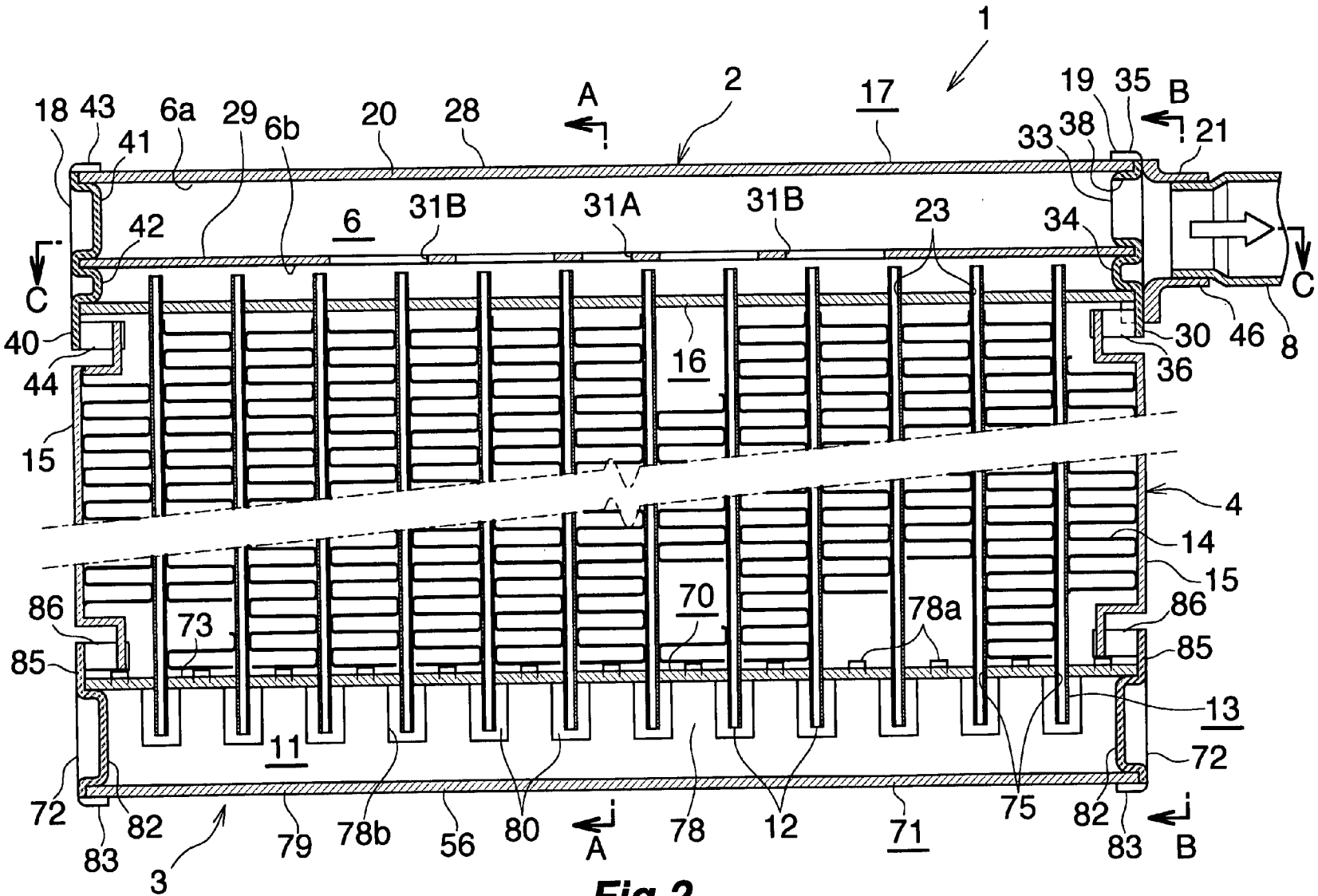
FIG. 2 is a fragmentary view in vertical section showing the evaporator of FIG. 1 with its intermediate portion omitted.
Figure 3:
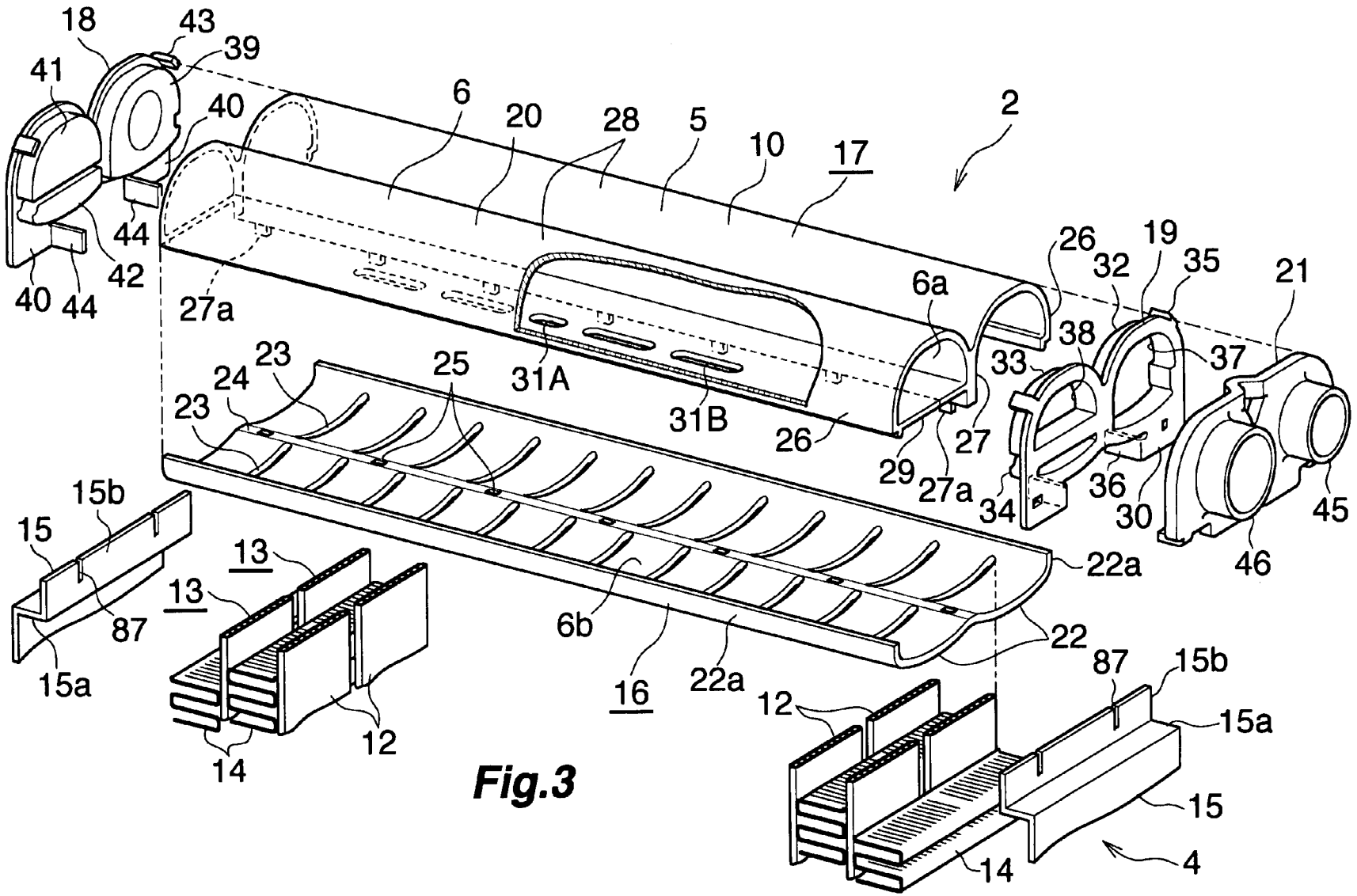
FIG. 3 is an exploded perspective view of a refrigerant inlet/outlet tank of the evaporator of FIG. 1.
Figure 10:
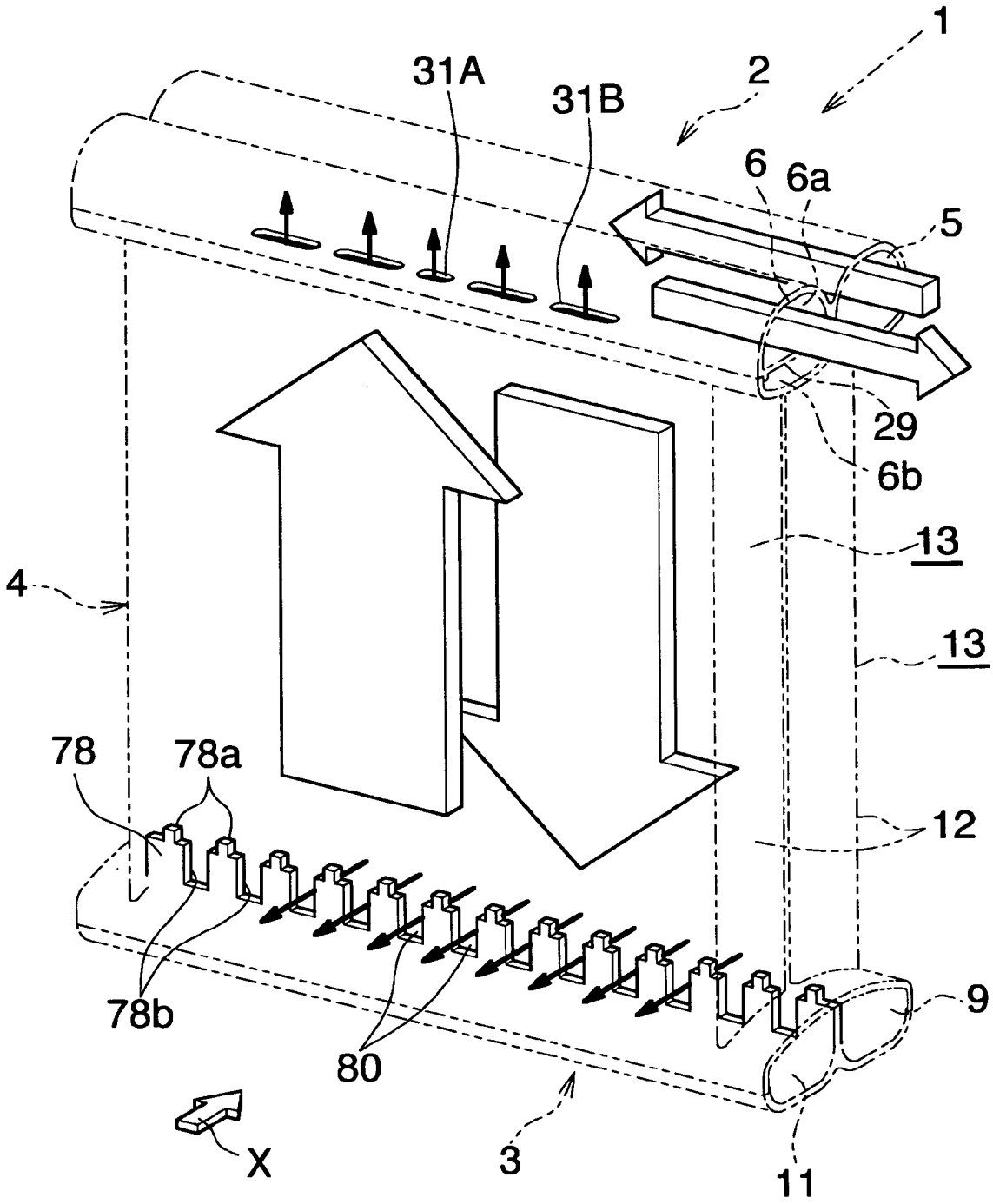
FIG. 10 is a diagram showing the flow of a refrigerant in the evaporator of FIG. 1.

FIGS. 1 and 2 show the overall configuration of an evaporator for a car air conditioner to which the present invention is applied. FIGS. 3 to 9 show the configuration of essential portions of the evaporator. FIG. 10 shows how a refrigerant flows in the evaporator.

In FIGS. 1 and 2, the evaporator 1, which is used in a car air conditioner using a chlorofluorocarbon-based refrigerant, includes a refrigerant inlet/outlet tank 2 made of aluminum and a refrigerant turn tank 3 made of aluminum, the tanks 2 and 3 being vertically spaced apart from each other, and further includes a heat exchange core section 4 provided between the tanks 2 and 3.

The refrigerant inlet/outlet tank 2 includes a refrigerant inlet header section 5 (first header section) located on a side toward the front (downstream side with respect to the air flow direction) and a refrigerant outlet header section 6 (second header section) located on a side toward the rear (upstream side with respect to the air flow direction). The refrigerant inlet header section 5 and the refrigerant outlet header section 6 are integral with each other via a connection means, which will be described later. A refrigerant inlet pipe 7 made of aluminum is connected to the refrigerant inlet header section 5 of the refrigerant inlet/outlet tank 2. A refrigerant outlet pipe 8 made of aluminum is connected to the refrigerant outlet header section 6. The refrigerant turn tank 3 includes a refrigerant inflow header section 9 (third header section) located on the side toward the front and a refrigerant outflow header section 11 (fourth header section) located on the side toward the rear. The refrigerant inflow header section 9 and the refrigerant outflow header section 11 are integral with each other via a connection means, which will be described later.

The heat exchange core section 4 is configured such that heat exchange tube groups 13 are arranged in a plurality of; herein, two, rows in the front-rear direction, each heat exchange tube group 13 consisting of a plurality of heat exchange tubes 12 arranged in parallel at predetermined intervals in the left-right direction. The upper and lower ends of the heat exchange tubes 12 of the front heat exchange tube group 13 are connected to the refrigerant inlet header section 5 and the refrigerant inflow header section 9, respectively. The upper and lower ends of the heat exchange tubes 12 of the rear heat exchange tube group 13 are connected to the refrigerant outlet header section 6 and the refrigerant outflow header section 11, respectively. Corrugate fins 14 are disposed within corresponding air-passing clearances between the adjacent heat exchange tubes 12 of the heat exchange tube groups 13 and on the outer sides of the leftmost and rightmost heat exchange tubes 12 of the heat exchange tube groups 13, and are brazed to the corresponding heat exchange tubes 12. Side plates 15 made of aluminum are disposed on the outer sides of the leftmost and rightmost corrugate fins 14, and are brazed to the corresponding corrugate fins 14.

As shown in FIGS. 3 to 7, the refrigerant inlet/outlet tank 2 includes a plate-like first member 16 which is formed from an aluminum brazing sheet having a brazing material layer on each of opposite sides thereof and to which the heat exchange tubes 12 are connected, and a second member 17 which is formed from a bare aluminum extrudate and covers the upper side of the first member 16.

The first member 16 has front and rear curved portions 22, whose central regions each have an arcuate cross section projecting downward and having a small curvature. A plurality of tube insertion holes 23, which are elongated in the front-rear direction, are formed in the curved portions 22 at predetermined intervals in the left-right direction. The tube insertion holes 23 of the front curved portion 22 and those of the rear curved portion 22 are identical in position in the left-right direction. A rising wall 22*a* is formed integrally with each of the front edge of the front curved portion 22 and the rear edge of the rear curved portion 22, over the entire length of the front and rear edges. A flat portion 24 is formed between the two curved portions 22 of the first member 16 and serves as means for connecting together the refrigerant inlet header section 5 and the refrigerant outlet header section 6. A plurality of through holes 25 are formed in the flat portion 24 at predetermined intervals in the left-right direction.

The second member 17 has a cross section resembling the letter m, which opens downward, and includes front and rear walls 26 extending in the left-right direction; a vertical, intermediate wall 27 provided at a central region thereof between the front and rear walls 26, extending in the left-right direction, and serving as means for connecting together the refrigerant inlet header section 5 and the refrigerant outlet header section 6; and two generally arcuate connection walls 28 projecting upward and integrally connecting the upper end of the intermediate wall 27 and the upper ends of the front and rear walls 26. A flow-dividing resistance plate 29 (dividing means) for dividing the interior of the refrigerant outlet header section 6 into an upper space 6*a* and an lower space 6*b*, integrally connects a lower end portion of the rear wall 26 of the second member 17 and a lower end portion of the intermediate wall 27 over the entire length thereof. A plurality of refrigerant passage holes 31A and 31B in a through-hole form and elongated in the left-right direction are formed in a rear region, excluding left and right end portions thereof, of the flow-dividing resistance plate 29 at predetermined intervals in the left-right direction. The lower end of the intermediate wall 27 projects downward beyond the lower ends of the front and rear walls 26. A plurality of projections 27*a* are integrally formed on the lower end face of the intermediate wall 27 at predetermined intervals in the left-right direction in such a manner as to project downward, and are fitted into corresponding through holes 25 of the first member 16. The projections 27*a* are formed by cutting off predetermined portions of the intermediate wall 27.

The front curved portion 22 and the flat portion 24 of the first member 16, and the front wall 26, the intermediate wall 27, and the front connection wall 28 of the second member 17 form a hollow header section body 10, whose left and right ends are opened, of the refrigerant inlet header section 5. The rear curved portion 22 and the flat portion 24 of the first member 16, and the rear wall 26, the intermediate wall 27, and the rear connection wall 28 of the second member 17 form a hollow header section body 20, whose left and right ends are opened, of the refrigerant outlet header section 6. The header section bodies 10 and 20 are integral with each other via connection means composed of the flat portion 24 and the intermediate wall 27.

The right end openings of the header section bodies 10 and 20 are closed by a right cap 19 which is formed from an aluminum brazing sheet having a brazing material layer on each of opposite sides thereof and which is brazed to right end portions of the header section bodies 10 and 20 while bridging the right end portions. A plate-like pipe joint member 21 made of aluminum and elongated in the front-rear direction is brazed to the outer surface of the right cap 19. The left end openings of the header section bodies 10 and 20 are closed by a left cap 18 which is formed from an aluminum brazing sheet having a brazing material layer on each of opposite sides thereof and which is brazed to left end portions of the header section bodies 10 and 20 while bridging the left end portions.

A leftward-projecting concave portion 32 to be fitted into the header section body 10 of the refrigerant inlet header section 5 is integrally formed on a front portion of the right cap 19. Similarly, a leftward-projecting upper concave portion 33 to be fitted into the upper space 6*a* of the header section body 20 of the refrigerant outlet header section 6 located above the flow-dividing resistance plate 29, and a leftward-projecting lower concave portion 34 to be fitted into the lower space 6*b* of the header section body 20 of the refrigerant outlet header section 6 located under the flow-dividing resistance plate 29 are integrally formed on a rear portion of the right cap 19 while being vertically separated from each other. An entire bottom wall portion is cut out from the leftward-projecting concave portion 32 of the right cap 19, thereby forming a refrigerant inlet 37. Similarly, an entire bottom wall portion is cut out from the leftward-projecting upper concave portion 33 of the right cap 19, thereby forming a refrigerant outlet 38. An engagement finger 35 projecting leftward is formed integrally with each of an arcuate portion extending between the front side edge and the top edge of the right cap 19 and an arcuate portion extending between the rear side edge and the top edge of the right cap 19. The engagement fingers 35 are engaged with the corresponding connection walls 28 of the second member 17.

Two downward-projecting portions 30 are formed integrally with a front end portion and a rear end portion, respectively, of a lower edge portion of the right cap 19. A vertical-plate-like projection piece 36 is integrally formed at an inner edge portion with respect to the front-rear direction of each of the downward-projecting portions 30 in such a manner as to project leftward while its thickness direction coincides with the front-rear direction, and its width direction coincides with the vertical direction. Through holes 30*a* and 30*b* are formed in the two downward-projecting portions 30, respectively.

The pipe joint member 21 has an integrally formed short, cylindrical refrigerant inflow port 45 communicating with the refrigerant inlet 37 of the right cap 19, and an integrally formed short, cylindrical refrigerant outflow port 46 communicating with the refrigerant outlet 38 of the right cap 19. A diameter-reduced portion 7*a* formed at one end portion of the refrigerant inlet pipe 7 is inserted into and brazed to the refrigerant inflow port 45 of the pipe joint member 21. Similarly, a diameter-reduced portion 8*a* formed at one end portion of the refrigerant outlet pipe 8 is inserted into and brazed to the refrigerant outflow port 46 of the pipe joint member 21. Mating convex portions 21*a* and 21*b* which project leftward and are to be fitted into the through holes 30*a* and 30*b* of the right cap 19 are formed integrally with a front end portion and a rear end portion, respectively, of the lower edge of the pipe joint member 21. A slit 47 extending in the vertical direction is formed on the pipe joint member 21 between the refrigerant inflow port 45 and the refrigerant outflow port 46. Through holes 48 and 49 are formed at the upper and lower ends of the slit 47, respectively, such that the through holes 48 and 49 are connected with the slit 47. Further, a portion of the pipe joint member 21 located above the upper through hole 48 and a portion of the pipe joint member 21 located under the lower through hole 49 are bent such that these portions project leftward to thereby from bent portions 51. These upper and lower bent portions 51 come into engagement with the refrigerant inlet header section 5 and the refrigerant outlet header section 6 at a location therebetween; i.e., the central portions of the two members 16 and 17 and the right cap 19 with respect to the front-rear direction.

A rightward-projecting concave portion 39 to be fitted into the header section body 10 of the refrigerant inlet header section 5 is integrally formed on a front portion of the left cap 18. Similarly, a rightward-projecting upper concave portion 41 to be fitted into the upper space 6*a* of the header section body 20 of the refrigerant outlet header section 6 located above the flow-dividing resistance plate 29, and a rightward-projecting lower concave portion 42 to be fitted into the lower space 6*b* of the header section body 20 of the refrigerant outlet header section 6 located under the flow-dividing resistance plate 29 are integrally formed on a rear portion of the left cap 18 while being vertically separated from each other. An engagement finger 43 projecting rightward is formed integrally with each of an arcuate portion extending between the front side edge and the top edge of the left cap 18 and an arcuate portion extending between the rear side edge and the top edge of the left cap 18. The engagement fingers 43 are engaged with the corresponding connection walls 28 of the second member 17.

Two downward-projecting portions 40 are formed integrally with a front end portion and a rear end portion, respectively, of a lower edge of the left cap 18. A vertical-plate-like projection piece 44 is integrally formed at an inner edge with respect to the front-rear direction of each of the downward-projecting portions 40 in such a manner as to project rightward while its thickness direction coincides with the front-rear direction, and its width direction coincides with the vertical direction.

The first and second members 16 and 17 of the refrigerant inlet/outlet tank 2, the two caps 19 and 18, and the pipe joint member 21 are brazed together as follows. In assembly of the first and second members 16 and 17, the projections 27*a* of the second member 17 are inserted into the corresponding through holes 25 of the first member 16, followed by crimping. As a result, upper end portions of the front and rear rising walls 22*a* of the first member 16 come into engagement with the corresponding lower end portions of the front and rear walls 26 of the second member 17. In the thus-established condition, the first and second members 16 and 17 are brazed together by utilization of the brazing material layers of the first member 16. In attachment of the two caps 19 and 18, the front concave portions 32 and 39 are fitted into the header section body 10; the rear, upper concave portions 33 and 41 are fitted into an upper space of the header section body 20 located above the flow-dividing resistance plate 29; the rear, lower concave portions 34 and 42 are fitted into a lower space of the header section body 20 located below the flow-dividing resistance plate 29; and the engagement fingers 35 and 43 are fitted to the connection walls 28 of the second member 17. In the thus-established condition, the caps 19 and 18 are brazed to the first and second members 16 and 17 by utilization of the brazing material layers thereof. The pipe joint member 21 is brazed to the right cap 19 by utilization of the brazing material layer thereof in the condition that the upper bent portion 51 is in engagement with the central portions of the right cap 19 and the second member 17 with respect to the front-rear direction, the lower bent portion 51 is in engagement with the central portions of the right cap 19 and the first member 16, and the mating convex portions 21*a* and 21*b* are fitted into the through holes 30*a* and 30*b*, respectively, of the right cap 19.

The refrigerant inlet/outlet tank 2 is thus formed. A portion of the refrigerant inlet/outlet tank 2 located forward of the flat portion 24 of the first member 16 and the intermediate wall 27 of the second member 17 serves as the refrigerant inlet header section 5. A portion of the refrigerant inlet/outlet tank 2 located backward of the flat portion 24 of the first member 16 and the intermediate wall 27 of the second member 17 serves as the refrigerant outlet header section 6. The refrigerant inlet header section 5 and the refrigerant outlet header section 6 are integrated with each other. The flow-dividing resistance plate 29 divides the refrigerant outlet header section 6 into the upper and lower spaces 6*a* and 6*b*. The spaces 6*a* and 6*b* communicate with each other through the refrigerant passage holes 31A and 31B.

As shown in FIGS. 4, 5, 8, and 9, the refrigerant turn tank 3 includes a plate-like first member 70 which is formed from an aluminum brazing sheet having a brazing material layer on each of opposite sides thereof and to which heat exchange tubes 12 are connected, and a second member 71 which is formed from a bare aluminum extrudate and covers the lower side of the first member 70.

A top face 3*a* of the refrigerant turn tank 3 has such an arcuate transverse cross section that a central portion thereof with respect to the front-rear direction serves as a top portion 73 and that the height gradually decreases from the top portion 73 toward the front and rear sides. A plurality of grooves 74 are formed on front and rear portions of the refrigerant turn tank 3 at predetermined intervals along the left-right direction such that they extend from the front and rear sides of the top portion 73 of the top face 3*a* to front and rear side surfaces 3*b*.

The first member 70 has an arcuate transverse cross section such that a central portion thereof with respect to the front-rear direction projects upward. Downwardly extending walls 70*a* are formed integrally with front and rear edges of the first member 70 over the entire length thereof. The upper surface of the first member 70 serves as the top face 3*a* of the refrigerant turn tank 3. The outer surfaces of the downwardly extending walls 70*a* serve as the front and rear side surfaces 3*b* of the refrigerant turn tank 3. A plurality of the grooves 74 are formed at predetermined intervals in the left-right direction on the front and rear portions of the first member 70 in such a manner as to extend from the top portion 73 located at the center with respect to the front-rear direction to the lower ends of the downwardly extending walls 70*a*. Tube insertion holes 75 elongated in the front-rear direction are formed in the first member 70 excepting the top portion 73; i.e., in front and rear portions of the first member 70, such that the tube insertion holes 75 are located between the adjacent grooves 74. The front tube insertion holes 75 and the rear tube insertion holes 75 are identical in position in the left-right direction. A plurality of through holes 76 are formed in the top portion 73 of the first member 70 at predetermined intervals in the left-right direction.

The second member 71 has a transverse cross section resembling the letter w, which opens upward, and includes front and rear walls 77 curved upward and toward the outside with respect to the front-rear direction and extending in the left-right direction; a vertical intermediate wall 78 provided at a central portion of the second member 71 between the front and rear walls 77, extending in the left-right direction, and serving as connection means for connecting together the refrigerant inflow header section 9 and the refrigerant outflow header section 11; and two connection walls 79 integrally connecting the lower ends of the front and rear walls 77 and the lower end of the intermediate wall 78. The upper end of the intermediate wall 78 projects upward beyond the upper ends of the front and rear walls 77. A plurality of projections 78*a* projecting upward and to be fitted into the corresponding through holes 76 of the first member 70 are formed integrally with the upper end of the intermediate wall 78 at predetermined intervals in the left-right direction. Refrigerant passage cutouts 78*b* are formed between the adjacent projections 78*a* of the intermediate wall 78 in such a manner as to extend from its upper edges. The projections 78*a* and the cutouts 78*b* are formed by cutting out predetermined portions of the intermediate wall 78.

A front half portion of the first member 70, the front wall 77 of the second member 71, the intermediate wall 78, and the front connection wall 79 form a header section body 55, whose left and right ends are opened, of the refrigerant inflow header section 9. A rear half portion of the first member 70, a rear wall 77 of the second member 71, the intermediate wall 78, and the rear connection wall 79 form a header section body 56, whose left and right ends are opened, of the refrigerant outflow header section 11. The header section bodies 55 and 56 are integral with each other via connection means composed of the top portion 73 and the intermediate wall 78.

The opposite end openings of the header section bodies 55 and 56 are closed by caps 72 formed from an aluminum brazing sheet having a brazing material layer on each of opposite sides thereof. A concave portion 81 which projects inward with respect to the left-right direction and is fitted into the header section body 55 of the refrigerant inflow header section 9 is integrally formed on a front portion of each of the caps 72. Similarly, a concave portion 82 which projects inward with respect to the left-right direction and is fitted into the header section body 56 of the refrigerant outflow header section 11 is integrally formed on a rear portion of each of the caps 72. An engagement finger 83 projecting inward with respect to the left-right direction is formed integrally with each of an arcuate portion extending between the front side edge and the bottom edge of each cap 72 and an arcuate portion extending between the rear side edge and the bottom edge of each cap 72. The engagement fingers 83 are engaged with the corresponding front and rear walls 77 of the second member 71.

Two upward-projecting portions 85 are formed integrally with a front end portion and a rear end portion, respectively, of an upper edge portion of each of the caps 72. A vertical-plate-like projection piece 86 is integrally formed at an inner edge portion with respect to the front-rear direction of each of the upward-projecting portions 85 in such a manner as to project inward with respect to the left-right direction while its thickness direction coincides with the front-rear direction, and its width direction coincides with the vertical direction.

The first and second members 70 and 71 of the refrigerant return tank 3 and the two caps 72 are brazed together as follows. In assembly of the first and second members 70 and 71, the projections 78*a* of the second member 71 are inserted into the corresponding through holes 76, followed by crimping. As a result, lower end portions of the front and rear downwardly extending walls 70*a* of the first member 70 are fitted to corresponding upper end portions of the front and rear walls 77 of the second member 71. In the thus-established condition, the first and second members 70 and 71 are brazed together by utilization of the brazing material layers of the first member 70. In attachment of the two caps 72, the front concave portion 81 is fitted into the header section body 55; the rear concave portion 82 is fitted into the header section body 56; and the engagement fingers 83 are engaged with the front and rear walls 77 of the second member 71. In the thus-established condition, the two caps 72 are brazed to the first and second members 70 and 71 by utilization of the brazing material layers of the caps 72. The upper end openings of cutouts 78*b* of the intermediate wall 78 of the second member 71 are closed by the first member 70 to thereby form refrigerant passage holes 80.

The refrigerant turn tank 3 is thus formed. A portion of the refrigerant turn tank 3 located forward of the intermediate wall 78 of the second member 71 serves as the refrigerant inflow header section 9. A portion of the refrigerant turn tank 3 located backward of the intermediate wall 78 serves as the refrigerant outflow header section 11. The refrigerant inflow header section 9 and the refrigerant outflow header section 11 communicate with each other via the refrigerant passage holes 80.

Each of the heat exchange tubes 12 which constitute the front and rear heat exchange tube groups 13 of the heat exchange core section 4 is formed from an aluminum extrudate and assumes a flat form having a wide width in the front-rear direction. In the heat exchange tube 12, a plurality of refrigerant channels 12*a* extending in the longitudinal direction thereof are formed in parallel therein. Upper end portions of the heat exchange tubes 12 are inserted into the corresponding tube insertion holes 23 of the first member 16 of the refrigerant inlet/outlet tank 2 and brazed to the first member 16 by utilization of the brazing material layers of the first member 16. Lower end portions of the heat exchange tubes 12 are inserted into the corresponding tube insertion holes 75 of the first member 70 of the refrigerant turn tank 3 and brazed to the first member 70 by utilization of the brazing material layers of the first member 70.

Preferably, the thickness of the heat exchange tube 12 as measured in the left-right direction; i.e., a tube height, is 0.75 mm to 1.5 mm; the width of the heat exchange tube 12 as measured in the front-rear direction is 12 mm to 18 mm; the wall thickness of the heat exchange tube 12 is 0.175 mm to 0.275 mm; the thickness of a intermediate wall separating the refrigerant channels from each other is 0.175 mm to 0.275 mm; the pitch of the intermediate walls is 0.5 mm to 3.0 mm; and the front and rear end walls each have a radius of curvature of 0.35 mm to 0.75 mm as measured on the outer surface thereof.

In place of use of the heat exchange tube 12 formed from an aluminum extrudate, a heat exchange tube to be used may be formed such that an inner fin is inserted into a seam welded pipe of aluminum so as to form a plurality of refrigerant channels therein. Alternatively, a heat exchange tube to be used may be formed as follows. An aluminum brazing sheet having a brazing material layer on one side thereof is subjected to a rolling process performed on the side where the brazing material is present, so as to form a plate that includes two flat-wall-forming portions connected together via a connection portion; side-wall-forming portions, which are formed, in a bulging condition, integrally with the corresponding flat-wall-forming portions at their side edges located in opposition to the connection portion; and a plurality of partition-wall-forming portions, which are formed integrally with the flat-wall-forming portions in such a manner as to project from the flat-wall-forming portions and to be arranged at predetermined intervals in the width direction of the flat-wall-forming portions. The thus-prepared plate is bent at the connection portion into a hairpin form such that the side-wall-forming portions abut each other, followed by brazing. The partition-wall-forming portions become intermediate walls.

Each of the corrugated fins 14 is made in a wavy form from an aluminum brazing sheet having a brazing material layer over opposite surfaces thereof. The corrugate fin 14 includes wave crest portions, wave trough portions, and connection portions each connecting together the wave crest portion and the wave trough portion. A plurality of louvers are formed at the connection portions in such a manner as to be juxtaposed in the front-rear direction. The front and rear heat exchange tube groups 13 share the corrugate fin 14. The width of the corrugate fin 14 as measured in the front-rear direction is approximately equal to the span between the front edges of the heat exchange tubes 12 of the front heat exchange group 13 and the rear edges of the rear heat exchange tubes 12 of the rear heat exchange tube group 13. The fin height of the corrugate fin 14 means a direct distance between the wave crest portion and the wave through portion, and is preferably 7.0 mm to 10.0 mm. The fin pitch of the corrugate fin 14 means half the distance between the centers in the vertical direction of adjacent wave crest portions or wave through portions, and is preferably 1.3 mm to 1.8 mm. Instead of a single corrugate fin being shared between the front and rear heat exchange tube groups 13, a corrugate fin may be disposed between the adjacent heat exchange tubes 12 of each of the front and rear heat exchange tube groups 13.

First bent portions 15*a* projecting inward in the left-right direction are integrally formed at corresponding vertically opposite end portions of the two side plates 15. Second bent portions 15*b* projecting vertically outward are formed integrally with corresponding inward ends of the first bent portions 15*a*. A plurality of; herein, two, slits 87 are formed in each of the second bent portions 15*b* while extending vertically from a vertical end of the second bent portion 15*b* and being arranged at predetermined intervals in the front-rear direction. The slits 87 serve as through-hole portions for allowing the projection pieces 36, 44, and 86 of the caps 19, 18, and 72 of the refrigerant inlet/outlet tank 2 and the refrigerant turn tank 3 to be inserted thereinto. No particular limitation is imposed on the form of the slits 87. In place of the form of extending from the ends of the second bent portions 15*b*, the slits 87 may be formed in the form of through holes in the second bent portions 15*b*.

The two side plates 15 and the caps 19, 18, and 72 of the refrigerant inlet/outlet tank 2 and the refrigerant turn tank 3 are brazed together as follows. Before the concave portions 32, 33, 34, 39, 41, 42, 81, and 82 of the caps 19, 18, and 72 are fitted into the header section bodies 10, 20, 55, and 56, the projection pieces 36, 44, and 86 of the caps 19, 18, and 72 are inserted into the corresponding slits 87 of the side plates 15 in such a manner as to be movable in the left-right direction, thereby engaging vertically opposite end portions of the side plates 15 with the upper and lower caps 19, 18, and 72. In the thus-established condition, the concave portions 32, 33, 34, 39, 41, 42, 81, and 82 of the caps 19, 18, and 72 are fitted into the header section bodies 10, 20, 55, and 56, and then the vertically opposite end portions of the side plates 15 are brazed to the upper and lower caps 19, 18, and 72.

In manufacture of the evaporator 1, constituent members thereof excluding the refrigerant inlet pipe 7 and the refrigerant outlet pipe 8 are assembled and provisionally fixed together, and then all the constituent members are brazed together. Specifically, after the first and second members 16 and 17 of the refrigerant inlet/outlet tank 2, the first and second members 70 and 71 of the refrigerant turn tank 3, the heat exchange tubes 12, and the corrugate fins 14 are assembled, the projection pieces 36, 44, and 86 of the caps 19, 18, and 72 are inserted into the corresponding slits 87 of the side plates 15 in such a manner as to be movable in the left-right direction, thereby engaging vertically opposite end portions of the side plates 15 with the upper and lower caps 19, 18, and 72. In the thus-established condition, the concave portions 32, 33, 34, 39, 41, 42, 81, and 82 of the caps 19, 18, and 72 are fitted into the header section bodies 10, 20, 55, and 56, thereby disposing the side plates 15 on the outer sides of the leftmost and rightmost corrugate fins 14 and provisionally fixing the constituent members together. Subsequently, simultaneously are brazed together the heat exchange tubes 12 and the corrugate fins 14; the heat exchange tubes 12 and the first members 16 and 70 of the header section bodies 10, 20, 55, and 56; the first members 16 and 70 and the second members 17 and 71 of the header section bodies 10, 20, 55, and 56; the header section bodies 10, 20, 55, and 56 and the caps 19, 18, and 72; the side plates 15 and the caps 19, 18, and 72; and the side plates 15 and the corrugate fins 14. The evaporator 1 is thus manufactured.

The evaporator 1, together with a compressor, a condenser (refrigerant cooler), and an expansion valve (pressure-reducing device), constitutes a refrigeration cycle which uses a chlorofluorocarbon-based refrigerant. This refrigeration cycle is installed in a vehicle, such as an automobile, as a car air conditioner.

In the evaporator 1 described above, as shown in FIG. 10, a two-phase refrigerant of vapor-liquid phase having passed through a compressor, a condenser, and an expansion valve (pressure-reducing device) enters the refrigerant inlet header section 5 from the refrigerant inlet pipe 7 through the refrigerant inflow port 45 of the pipe joint member 21 and the refrigerant inlet 37 of the right cap 19. Then, the refrigerant dividedly flows into the refrigerant channels 12*a* of all the heat exchange tubes 12 of the front heat exchange tube group 13.

The refrigerant having entered the refrigerant channels 12*a* of all the heat exchange tubes 12 flows downward through the refrigerant channels 12*a* and enters the refrigerant inflow header section 9 of the refrigerant turn tank 3. The refrigerant having entered the refrigerant inflow header section 9 passes through the refrigerant passage holes 80 of the intermediate wall 78 and enters the refrigerant outflow header section 11.

The refrigerant having entered the refrigerant outflow header section 11 dividedly flows into the refrigerant channels 12*a* of all the heat exchange tubes 12 of the rear heat exchange tube group 13; flows upward, in opposition to the previous flow direction, through the refrigerant channels 12*a*; and enters the lower space 6*b* of the refrigerant outlet header section 6. Since the flow-dividing resistance plate 29 imparts resistance to the flow of the refrigerant, the divided flow from the refrigerant outflow header section 11 to all the heat exchange tubes 12 of the rear heat exchange tube group 13 becomes uniform, and the divided flow from the refrigerant inlet header section 5 to all the heat exchange tubes 12 of the front heat exchange tube group 13 becomes uniform to a greater extent. As a result, the refrigerant flow rate becomes uniform among all the heat exchange tubes 12 of the two heat exchange tube groups 13.

Then, the refrigerant passes through the refrigerant passage holes 31A and 31B of the flow-dividing resistance plate 29 and enters the upper space 6*a* of the refrigerant outlet header section 6. Subsequently, the refrigerant flows out to the refrigerant outlet pipe 8 through the refrigerant outlet 38 of the right cap 19 and the refrigerant outflow port 46 of the pipe joint member 21. While flowing through the refrigerant channels 12*a* of the heat exchange tubes 12 of the front heat exchange tube group 13 and through the refrigerant channels 12*a* of the heat exchange tubes 12 of the rear heat exchange tube group 13, the refrigerant is subjected to heat exchange with the air flowing through the air-passing clearances in the direction of arrow X shown in FIGS. 1 and 10 flows out from the evaporator 1 in a vapor phase.

During the heat exchange, condensed water is generated on the surface of the corrugate fins 14. The condensed water flows downward onto the top face 3*a* of the refrigerant turn tank 3. Then, the condensed water, by the capillary effect, enters the grooves 74; flows through the grooves 74; and drops downward below the refrigerant turn tank 3 from front and rear end portions of the grooves 74. This mechanism prevents freezing of condensed water which could otherwise result from stagnation of condensed water in a large amount in the region between the top face 3*a* of the refrigerant turn tank 3 and the lower ends of the corrugate fins 14. As a result, a drop in performance of the evaporator 1 is prevented.

Figure 11:
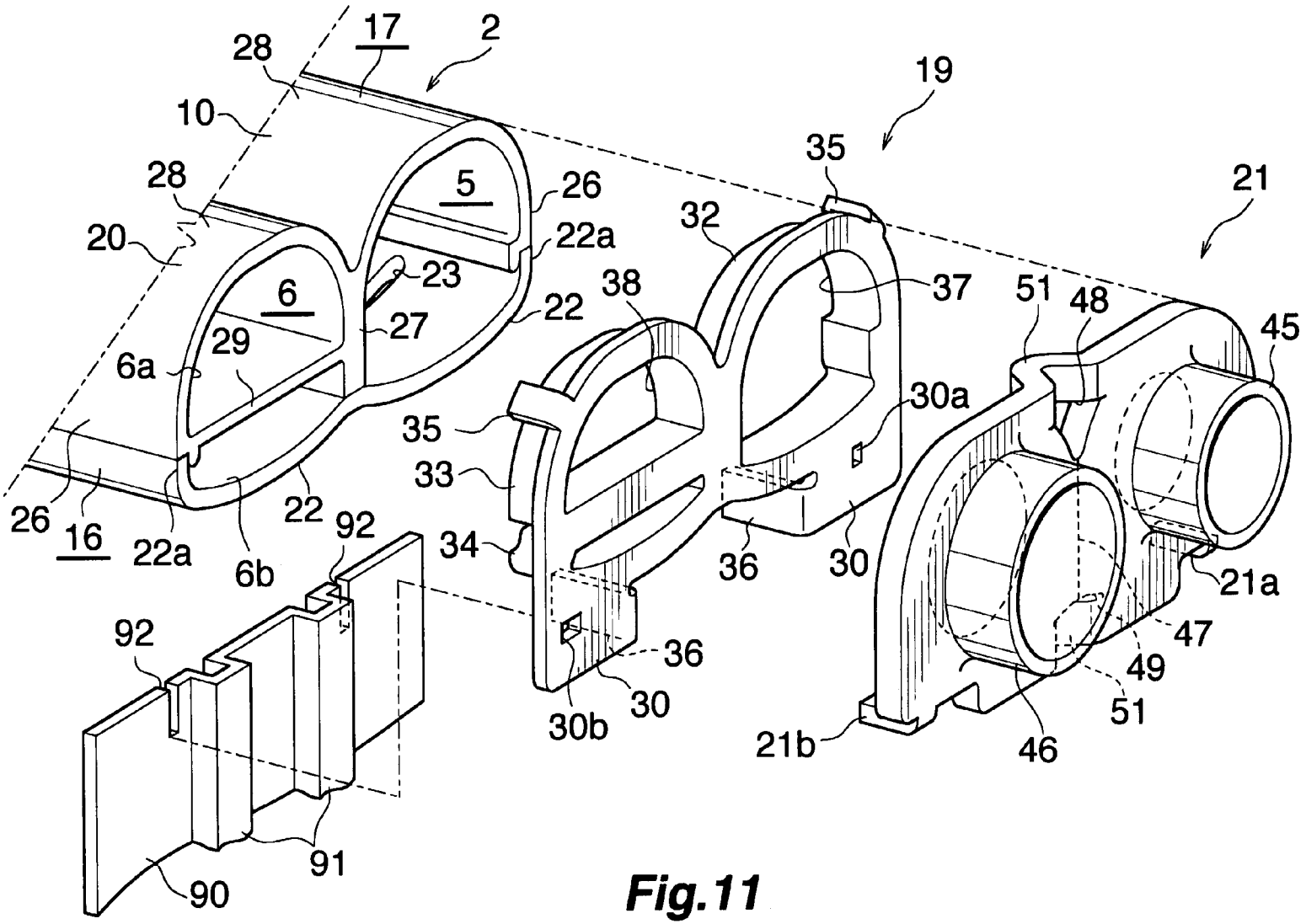
FIG. 11 is a view equivalent to FIG. 7 showing a modified side plate.

FIG. 11 shows a modified side plate.

In a side plate 90 shown in FIG. 11, in place of forming bent portions at vertically opposite end portions of a side plate, a plurality of; herein, two, ribs 91 each having a cross section resembling the letter U are formed at predetermined intervals in the front-rear direction. The ribs 91 project outward with respect to the left-right direction and extend vertically. Slits 92 are formed in vertically opposite end portions of the side plate 90 while extending vertically from the vertically opposite ends of the side plate 90 and being located frontward of the front rib 91 and rearward of the rear rib 91. The slits 92 serve as through-hole portions for allowing the projection pieces 36, 44, and 86 of the caps 19, 18, and 72 of the refrigerant inlet/outlet tank 2 and the refrigerant turn tank 3 to be inserted thereinto. No particular limitation is imposed on the form of the slits 92. In place of the form of extending from the ends of the side plates 90, the slits 92 may be formed in the form of through holes in the side plates 90.

The side plates 90 and the caps 19, 18, and 72 of the refrigerant inlet/outlet tank 2 and the refrigerant turn tank 3 are brazed together in a manner similar to that of the above-described embodiment.

In the above-described embodiment, the projection pieces of the caps each assume the form of a vertical plate body whose thickness direction coincides with the air flow direction and whose width direction coincides with a longitudinal direction of the side plates, and the through-hole portions of the side plates each assume the form of a slit extending in the longitudinal direction of the side plates. However, the present invention is not limited thereto. The shapes of the projection pieces and the through-hole portions can be modified as appropriate so long as the projection pieces can be inserted into the corresponding through-hole portions.

In the above-described embodiment, a single heat exchange tube group 13 is provided between the refrigerant inlet header section 5 and the refrigerant inflow header section 9 of the tanks 2 and 3, respectively, and a single heat exchange tube group 13 is provided between the refrigerant outlet header section 6 and the refrigerant outflow header section 11 of the tanks 2 and 3, respectively. However, the present invention is not limited thereto. For example, the following configuration may be employed: one or more heat exchange groups 13 are provided between the refrigerant inlet header section 5 and the refrigerant inflow header section 9 of the tanks 2 and 3, respectively; and one or more heat exchange groups 13 are provided between the refrigerant outlet header section 6 and the refrigerant outflow header section 11 of the tanks 2 and 3, respectively. Also, the refrigerant turn tank may be located above the refrigerant inlet/outlet tank.

The above embodiment is described while mentioning the heat exchanger applied to an evaporator of a car air conditioner which uses a chlorofluorocarbon-based refrigerant. However, the present invention is not limited thereto. The heat exchanger of the present invention may be used as an evaporator of a car air conditioner used in a vehicle, for example, an automobile, the car air conditioner including a compressor, a gas cooler (refrigerant cooler), an intermediate heat exchanger, an expansion valve (pressure-reducing device), and an evaporator and using a $CO_2$ refrigerant.

In the above-described embodiment, in order to enhance drainage performance, the refrigerant turn tank 3 has the grooves 74 formed in regions between the adjacent heat exchange tubes 12. However, the present invention is not limited thereto. Grooves for enhancing drainage performance may be formed at positions corresponding to the heat exchange tubes 12. In this case, in a region of the refrigerant turn tank 3 extending from the top face 3*a* to the front and rear side surfaces 3*b*, grooves for enhancing drainage performance are formed to extend from the outer ends of the tube insertion holes 75 with respect to the front-rear direction.

What is claimed is:

1. A heat exchanger comprising:

a heat exchange core section comprising a plurality of rows of heat exchange tube groups arranged in an air flow direction, each heat exchange tube group having a plurality of heat exchange tubes arranged in a left-right direction at predetermined intervals, a plurality of fins disposed between and joined to the adjacent heat exchange tubes and disposed on the outer sides of and joined to the leftmost and rightmost heat exchange tubes, and two side plates disposed on the outer sides of the leftmost and rightmost fins, respectively, and joined thereto;

a first header section which is disposed on a first-end side of the heat exchange tubes and to which the heat exchange tubes of at least a single heat exchange tube group are connected;

a second header section which is disposed on the first-end side of the heat exchange tubes and upstream of the first header section with respect to the air flow direction and to which the heat exchange tubes of the remaining heat exchange tube group or groups are connected;

a third header section which is disposed on a second-end side of the heat exchange tubes and to which the heat exchange tubes connected to the first header section are connected; and a fourth header section which is disposed on the second-end side of the heat exchange tubes and to which the heat exchange tubes connected to the second header section are connected, wherein the first and second header sections have two hollow header section bodies whose left and right ends are open, and two caps which are joined to left and right end portions of the two header section bodies while bridging the left end portions and the right end portions, respectively, thereby closing openings of the left and right ends of the two header section bodies, the third and fourth header sections have two hollow header section bodies whose left and right ends are open, and two caps which are joined to left and right end portions of the two header section bodies while bridging the left end portions and the right end portions, respectively, thereby closing openings of the left and right ends of the two header section bodies, while end portions of the side plates are engaged with the respective caps, the side plates are joined to the caps and fins, a plurality of projection pieces projecting inward with respect to the left-right direction is provided on the caps, respectively, a plurality of through-hole portions for allowing the projection pieces of the caps to be inserted thereinto is formed at end portions of the side plates, respectively, the projection pieces of the caps are inserted into the through-hole portions of the side plates, whereby the end portions of the side plates are engaged with the caps, the projection pieces are provided on the caps at predetermined intervals in the air flow direction, the through-hole portions corresponding to the projection pieces are formed in the side plates, a plurality of first bent portions projecting inward in the left-right direction are integrally formed at corresponding vertically opposite end portions of two of the side plates, a plurality of second bent portions projecting in the longitudinal direction of the side plates is formed integrally with corresponding inward ends of the first bent portions, and the through-hole portion are formed on the second end portions.

2. A heat exchanger according to claim 1, wherein each of the projection pieces of the caps has a vertical plate body whose thickness direction coincides with the air flow direction and whose width direction coincides with the longitudinal direction of the side plates, and each of the through-hole portions of the side plates comprises a slit extending in the longitudinal direction of the side plates.

3. A heat exchanger according to claim 1, wherein each of the caps has concave portions to be fitted into the corresponding header section bodies.

4. A heat exchanger according to claim 1, wherein the header section body of the first header section and the header section body of the second header section are integral with each other.

5. A heat exchanger according to claim 1, wherein the header section body of the third header section and the header section body of the fourth header section are integral with each other.

* * * * *